US008293074B2

(12) United States Patent
Gauvin et al.

(10) Patent No.: US 8,293,074 B2
(45) Date of Patent: Oct. 23, 2012

(54) SYSTEMS AND METHODS FOR CLEANING AND CONDITIONING A MOVING SURFACE USING CLEANING APPARATUS WITH PLATE ELEMENTS FOR MOUNTING TO DOCTOR BLADE HOLDERS

(75) Inventors: Royal Gauvin, Windham, ME (US); Marcelo De Boni, Rio Claro (BR); Allen J. Brauns, Sturbridge, MA (US); Daire Kavanagh, West Boylston, MA (US)

(73) Assignee: Kadant, Inc., Westford, MA (US)

( * ) Notice: Subject to any disclaimer, the term of this patent is extended or adjusted under 35 U.S.C. 154(b) by 80 days.

(21) Appl. No.: 12/715,775

(22) Filed: Mar. 2, 2010

(65) Prior Publication Data

US 2010/0218909 A1 Sep. 2, 2010

Related U.S. Application Data

(60) Provisional application No. 61/156,706, filed on Mar. 2, 2009.

(51) Int. Cl.
*D21G 3/00* (2006.01)

(52) U.S. Cl. ..... 162/272; 162/199

(58) Field of Classification Search ..... 162/272, 162/199; 399/351
See application file for complete search history.

(56) References Cited

U.S. PATENT DOCUMENTS

| | | | |
|---|---|---|---|
| 2,403,434 | A | 7/1946 | Gulden |
| 3,014,833 | A | 12/1961 | Lee |
| 3,580,673 | A | 5/1971 | Yang |
| 3,749,014 | A | 7/1973 | Gates |
| 4,006,987 | A | 2/1977 | Tomono et al. |
| 4,218,131 | A | 8/1980 | Ito et al. |
| 4,227,350 | A | 10/1980 | Fitzer |
| 4,402,103 | A | 9/1983 | Yanagawa et al. |
| 4,571,071 | A | 2/1986 | Bothner |
| 4,704,823 | A | 11/1987 | Steinback |
| 4,953,252 | A | 9/1990 | Akisawa |
| 5,174,862 | A | 12/1992 | Hale et al. |
| 5,275,104 | A | 1/1994 | Corrado et al. |
| 5,379,695 | A | 1/1995 | Rieth et al. |
| 5,519,914 | A | 5/1996 | Egan |
| 5,597,449 | A | 1/1997 | Vestola et al. |
| 5,626,512 | A | 5/1997 | Palaikis et al. |
| 5,657,693 | A | 8/1997 | Kumaki et al. |
| 5,699,738 | A | 12/1997 | Corrado et al. |
| 5,704,290 | A | 1/1998 | Metrope et al. |
| 6,386,106 | B1 | 5/2002 | Stanka |
| 7,045,037 | B2 | 5/2006 | Conrad |
| 7,465,374 | B2 | 12/2008 | Porco |
| 2001/0026705 | A1 | 10/2001 | Sato et al. |

FOREIGN PATENT DOCUMENTS

| | | |
|---|---|---|
| DE | 202006004281 | 7/2006 |
| GB | 1266508 | 3/1972 |
| WO | WO 98/27279 | 6/1998 |

OTHER PUBLICATIONS

DE 20 2006 004 281, machine translation, Jul. 2006.*
International Preliminary Report on Patentability for PCT/US2010/025881, mailed on Sep. 15, 2011, 10 pages.

* cited by examiner

*Primary Examiner* — Mark Halpern
(74) *Attorney, Agent, or Firm* — Gesmer Updegrove LLP

(57) ABSTRACT

A cleaning apparatus is disclosed for processing a moving surface. The cleaning apparatus includes at least one pad that is coupled to a support shoe. The support shoe is attached to a first end of a plate element, and the plate element includes a second end that is adapted to be received by a doctor blade holder.

14 Claims, 10 Drawing Sheets

SYSTEMS AND METHODS FOR CLEANING AND CONDITIONING A MOVING SURFACE USING CLEANING APPARATUS WITH PLATE ELEMENTS FOR MOUNTING TO DOCTOR BLADE HOLDERS

PRIORITY

The present application claims priority to U.S. Provisional Patent Application Ser. No. 61/156,706 filed Mar. 2, 2009, the disclosure of which is hereby incorporated by reference in its entirety.

BACKGROUND

The invention generally relates to roll cleaning apparatus for web or sheet production processes, and relates in particular, to roll cleaning apparatus for rolls in papermaking machines and web converting machines.

In a papermaking machine, web converting operation, or any other web or sheet production process it is often necessary to clean and/or condition the rotating roll surfaces or other moving surfaces that are used to convey the product. Inadequate cleaning of these moving surfaces will result in a build-up of contaminants and debris that may lead to product defects and production losses.

The contaminants that build up on these moving surfaces may include adhesive residue from use of recycled fiber, pitch, precipitated calcium carbonate (PCC), clay, starch or other polymers from coatings used in the product. Prior art cleaning systems generally utilized to remove contaminants on these moving surfaces include doctoring systems as well as abrasive pad type cleaning systems.

As shown in FIG. 1, certain doctor systems used for cleaning a roll generally employ a doctor blade 10 to scrape the moving surface of a roll 12. The doctor blade 10 is supported by a position adjustable doctor assembly 14 that may include a doctor blade holder 16 with a top plate 26, and unloading and loading tubes 18, 20 within a tube tray 22 that is mounted to a position adjustable doctor back 24. The loading and unloading tubes 18, 20 provide that the top plate 26 (as well as the doctor blade 10 attached thereto) are pivotally attached to the tube tray 22 via mounting structures 27, 28 and a rod 29 that joins the mounting structures 27, 28 together. The doctor back 24 is also adjustable to position the doctor assembly 16 toward and away from the roll 12.

Such doctor blades are generally effective in removing water, fiber build up and the product itself during threading or when a sheet break occurs. Doctor blades are also generally effective at removing contaminants of some appreciable thickness, which allows the working edge of the blade to get underneath and lift the contaminant away from the moving surface. Such doctor blades however, are typically not very effective at removing contaminants (or haze) that is of a very small particle size and may be in the microscopic grooves or pores of the roll surface. Additionally, doctor blades are not typically effective at removing contaminants of minimal thickness (<0.010 inches) that are adhered to the moving surface with a very high bond strength.

Other prior art cleaning systems include a device that applies an abrasive pad against a moving surface such as a roll surface. U.S. Pat. No. 5,597,449, for example, discloses a device for conditioning a surface 30 of a roll 32 wherein the device includes a grinding member 34 that is attached to a back-up part 36 as shown in FIG. 2. The back-up part 36 includes a groove 38 for receiving an elongated tip edge of a blade 40 to thereby form an articulation joint about which the back-up part 36 may pivot. The blade 40 is disclosed to be coupled to a doctor device. While such a device may be quickly placed on the tip of a doctor blade, it is questionable how well such a device would work for certain paper making applications. For example, and notwithstanding the disclosure in U.S. Pat. No. 5,597,449 of the use of an oscillation actuator, it is questionable how well such a device would work in applications that require significant applied forces and reciprocating forces given that the backing-part 36 rests against the tipe edge of the blade 40 but is not attached to the blade 40. Moreover, any movement of the back-up part 36 with respect to the blade 40 would likely result in damage to the working edge of the blade 40.

Another prior art cleaning system disclosed in U.S. Pat. No. 5,597,449 includes a grinding member 42 that is attached to the working edge of a blade 44 adjacent the surface 30 of the roll 32 as shown in FIG. 3. The grinding material 42, however, is only attached to the end region of the blade 44 because only that region contacts the surface 30 of the roll 32. Moreover, the force of the grinding member 42 against the surface 30 is largely dependent on the stiffness of the blade 44, which will deflect when the applied force exceeds a certain threshold, thereby reducing an applied force against the surface 30.

Further prior art systems that include a cleaning pad provide improved cleaning, but further require substantially larger cleaning apparatus. For example, U.S. Pat. No. 7,465,374 discloses an apparatus for cleaning a roll in a papermaking machine, wherein a cleaning pad that conforms to the surface of a roll is mounted on a movable support structure that is movable into engagement with the roll surface. FIG. 4, for example, shows an embodiment that includes a scrubbing element 50 attached to a backing member 52, which in turn is attached to brackets 54 via fasteners 56. A longitudinal motion drive 58 is disclosed to be employed to move the brackets 54 via bearings 60 mounted on a block 62 in a reciprocal scrubbing motion. The drive 58 and block 62 are mounted on a movable plate 64 that is moveable with respect to a base plate 66 about a pin 68 via actuation of pneumatic bellows 70 such that the scrubbing element 50 is moved through a gap 'G' into and out of engagement with a surface of a roll 72. The position of the base plate 66 is bounded by a standoff 74 and a stop 76. Further devices disclosed in U.S. Pat. No. 7,465,374 include an internal plenum in the backing member 52 through which a vacuum is provided to draw particles from the surface of the roll 72 through grooves and openings in the backing member 52 adjacent the pad.

The above use of abrasive pads and positioning assemblies, however, require specialized equipment (including the base plate 66, the movable plate 64, the bellows 70 and the block 62), and the abrasive action is disclosed to be facilitated by the reciprocating (scrubbing) action that is provided by the longitudinal motion drive 58.

Although a doctor blade provides a low profile cleaning assembly, such a system is not effective for removing certain contaminants as discussed above, and although abrasive pad systems such as disclosed in U.S. Pat. No. 7,465,374 may provide improved cleaning in some applications, such cleaning apparatus are generally too large and costly for use in many applications. It is also desirable in some applications that a cleaning assembly be adapted to be readily, quickly and easily installed for application to a moving surface during machine down-time, yet also provide improved cleaning of the moving surface.

There remains a need therefore, for a cleaning system that can effectively remove various forms of contaminants from a moving surface (such as a roll or other moving surface) within a web or sheet processing system. Further, there remains a need for cleaning system that is compact so that it may be installed quickly and easily, without moving or modifying the doctor-back, for application to a moving surface during machine down-time, while also providing such improved performance removing various forms of contaminants from the moving surface.

SUMMARY

The invention provides a cleaning apparatus for processing a moving surface. In accordance with an embodiment, the cleaning apparatus includes at least one pad that is attached to a support shoe. The support shoe is coupled to a first end of a plate element, and the plate element includes a second end that is adapted to be received by a doctor blade holder.

In accordance with another embodiment, the invention provides a cleaning apparatus that includes a support shoe that couples the cleaning apparatus to a doctor-back of a papermaking machine such that the cleaning apparatus is positioned between the doctor-back and the moving surface. The cleaning apparatus is sufficiently low in profile that the doctor-back is in substantially the same position during use of the cleaning apparatus as it would be during machine processing using a doctor blade coupled to the doctor-back. The cleaning apparatus includes at least one plenum for directing a fluid under pressure toward at least one pad that is coupled to the support shoe.

In accordance with a further embodiment, the invention involves a method of providing a cleaning apparatus for processing a moving surface. The method includes the steps of removing a doctor blade from a doctor blade holder that is attached to a doctor back, positioning a plate element of the cleaning apparatus into the doctor blade holder, and positioning the plate element as well as a support shoe that is pivotally attached to the plate element and at least one pad coupled to the support shoe near the moving surface.

BRIEF DESCRIPTION OF THE ILLUSTRATED EMBODIMENTS

The following description may be further understood with reference to the accompanying drawings in which.

The drawings are shown for illustrative purposes only.

DETAILED DESCRIPTION OF THE ILLUSTRATED EMBODIMENTS

The invention concerns an apparatus that utilizes at least one cleaning pad in contact with a rotating roll or other moving surface to clean and/or condition the surface. Various embodiments of the invention provide an improved cleaning pad and cleaning pad support apparatus that may be retrofitted into existing doctoring systems or may be supplied with new doctoring systems. In certain embodiments, the cleaning pad support apparatus includes a fluid plenum that may be used to deliver a cooling or cleaning fluid to the abrasive pad area. Further embodiments provide improvements to a cleaning pad that make the replacement of pads easier and quicker.

It has been discovered that one or more abrasive pads may be applied to a roll surface using a pad support shoe that mounts to a doctor back (either directly or indirectly). In particular, it has been discovered that a support shoe may be provided on one end of an elongated plate element, and the other end of the elongated plate element may be positionable within a conventional doctor blade holder. The support shoe may be formed of an extruded material, such as for example, a metal alloy. The plate element is formed of an elongated, relatively thin material that transfers the force to the support shoe so that the pad(s) may be adjustably pressed against the roll surface, and further provides that the plate element, support shoe and one or more pads may be quickly and easily installed into a conventional doctor blade holder during machine down-time in accordance with certain embodiments.

Figure 1:
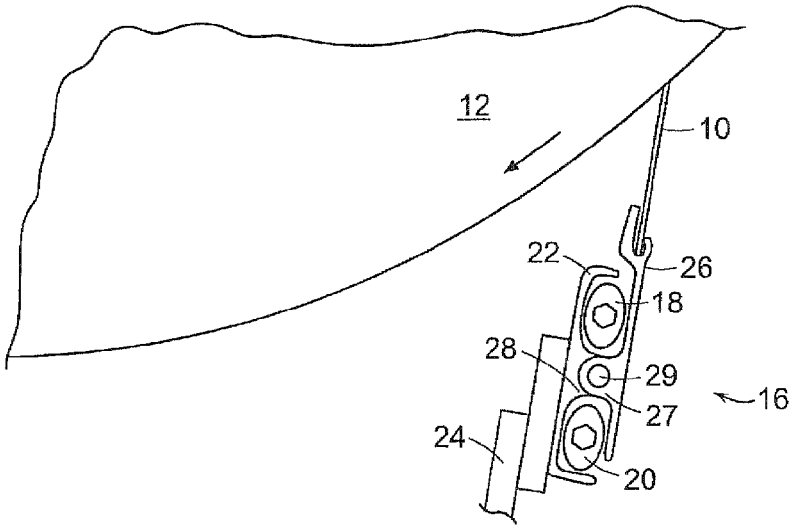
FIG. 1 PRIOR ART
FIG. 1 shows an illustrative diagrammatic side view of a roll cleaning apparatus of the prior art employing a doctor blade.
Figure 2:
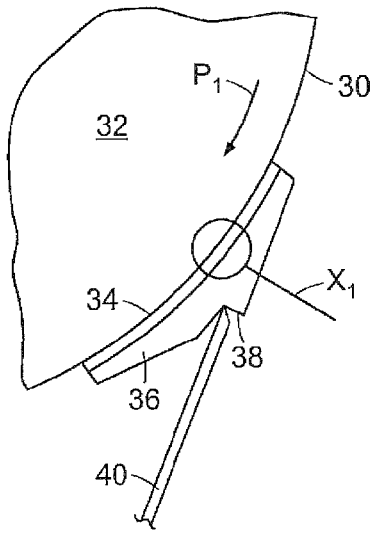
FIG. 2 PRIOR ART
FIG. 2 shows an illustrative diagrammatic side view of another roll cleaning apparatus of the prior art employing a conditioning pad.
Figure 3:
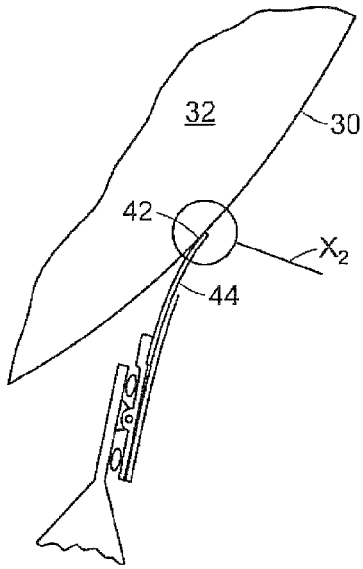
FIG. 3 PRIOR ART
FIG. 3 shows an illustrative diagrammatic side view of a further roll cleaning apparatus of the prior art employing a conditioning pad attached to a doctor blade.
Figure 4:
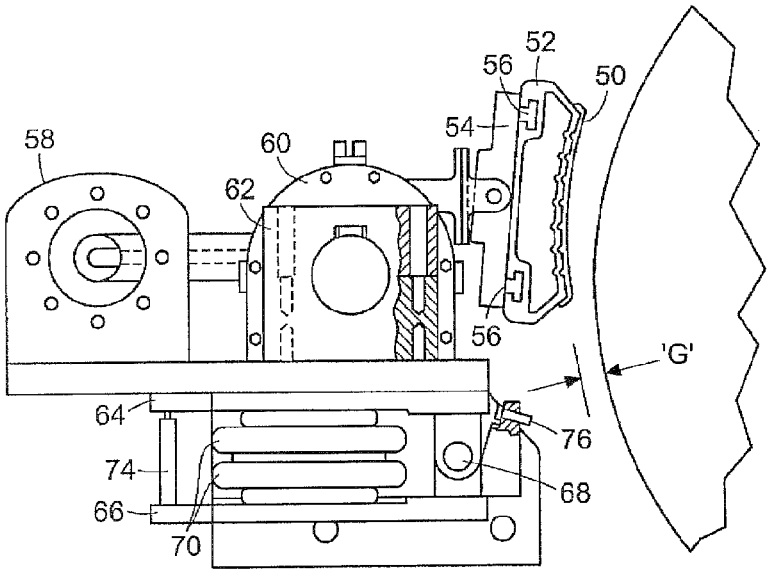
FIG. 4 PRIOR ART
FIG. 4 shows an illustrative diagrammatic side view of a further roll cleaning apparatus of the prior art employing an abrasive pad as well as a positioning and scrubbing system.
Figure 5:
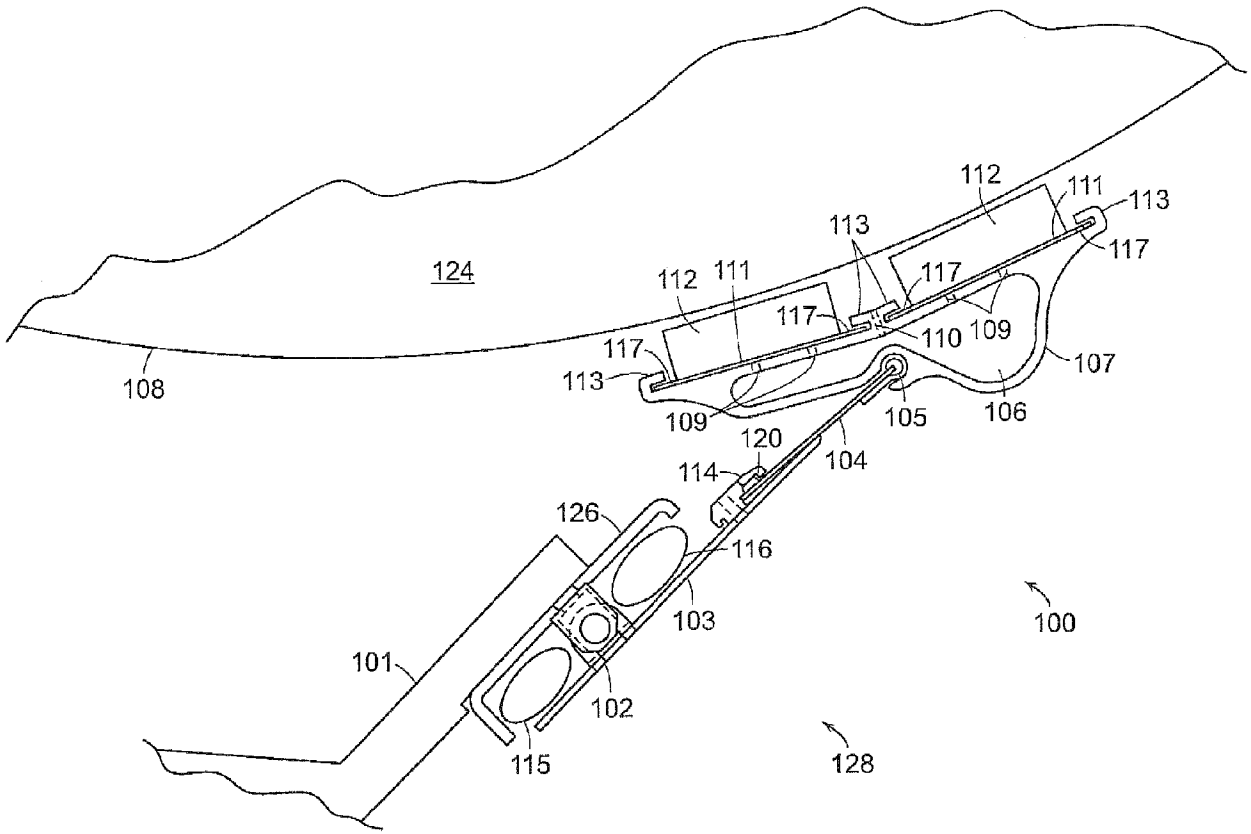
FIG. 5 shows an illustrative diagrammatic side view of a roll cleaning apparatus in accordance with an embodiment of the invention.
Figure 6:
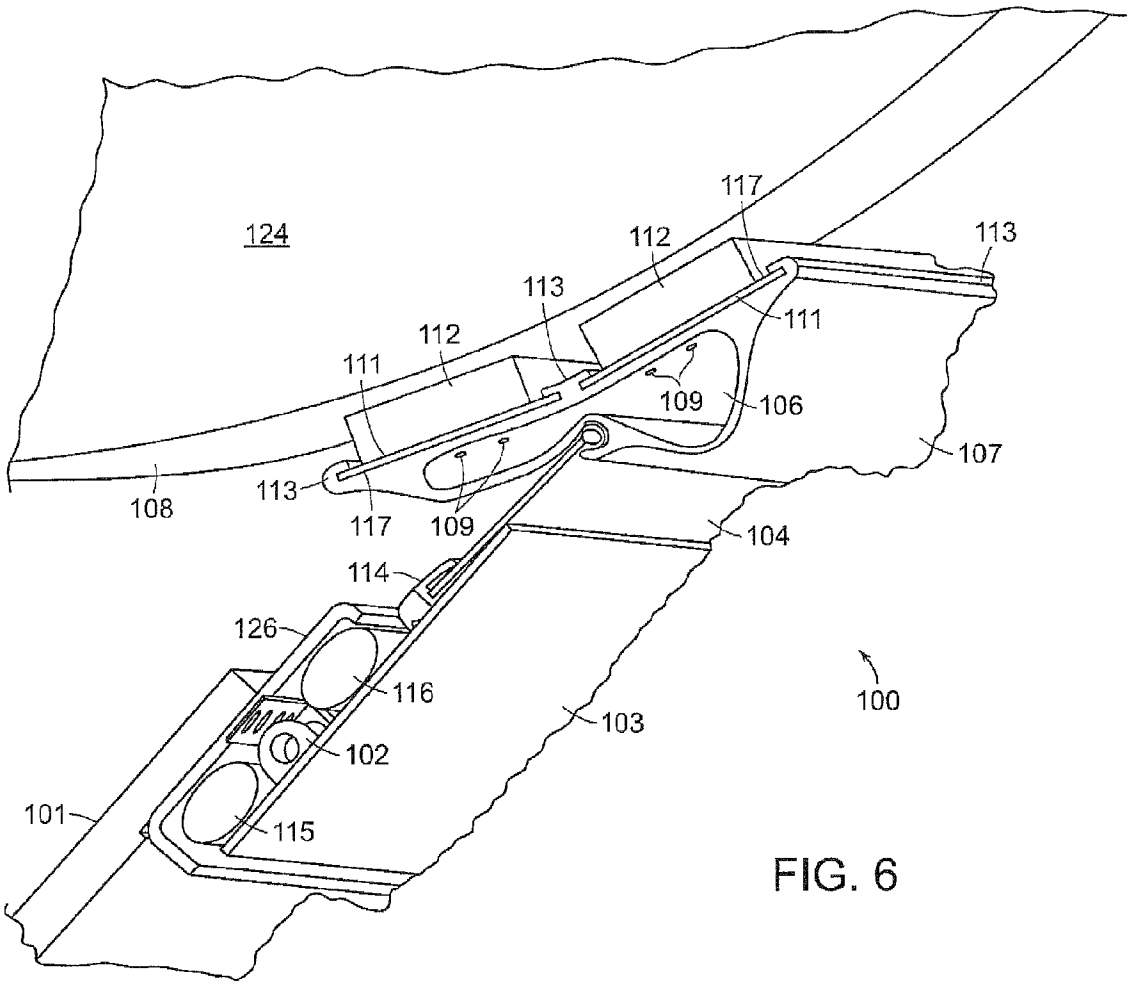
FIG. 6 shows an illustrative diagrammatic isometric view of a portion of the roll cleaning apparatus of FIG. 5.
Figure 7:
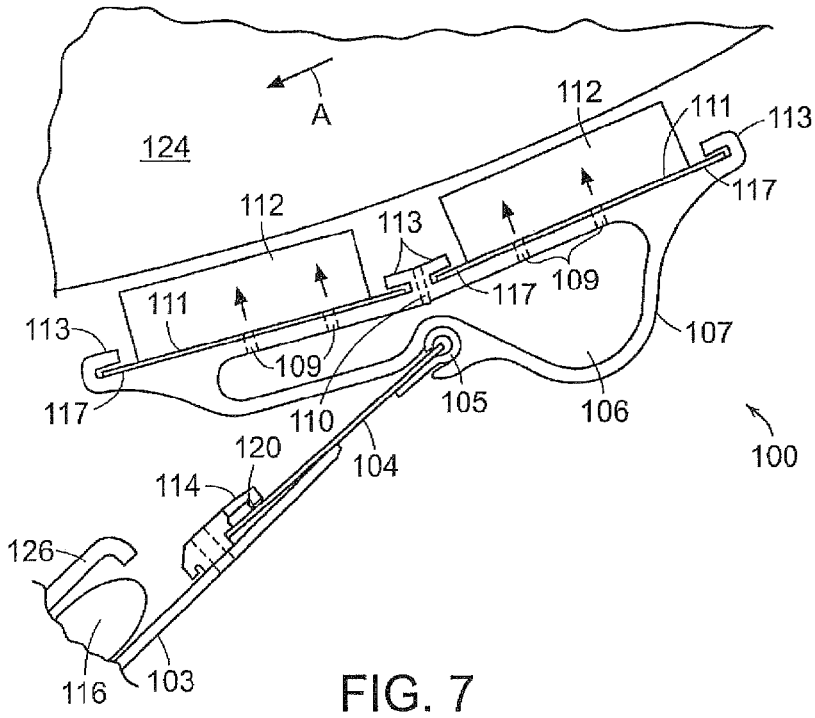
FIG. 7 shows an illustrative diagrammatic enlarged view of a portion of FIG. 5.

FIGS. 5, 6 and 7 show a cleaning apparatus 100 in accordance with an embodiment of the invention. The cleaning apparatus 100 may be used to clean rotating roll surfaces or any other moving surface that is used to convey a web or sheet type product. Various embodiments may also be suitable for applications where it may be beneficial, or even necessary, to clean the surface of the product itself. For example, metal processing lines may require that the product surface itself be cleaned and/or conditioned. In the paragraphs that follow, the term "moving surface" will be used to represent all of various applications.

The cleaning apparatus 100 includes a support shoe 107 that is pivotally coupled to a plate element 104. Cleaning pads 112 are each attached to a backing plate 111 (e.g., via adhesive or by using a hook-and-loop type fastener), and each backing plate 111 includes two elongated edges 117 that are received within elongated slots 113 that are formed in the support shoe 107. Each backing plate 111 may be formed, for example, of an extruded aluminum, a pultruded fiber reinforced plastic, a laminate composite material or other suitable material. The support shoe is coupled to the plate element 104 via an elongated curved hinge element 105 that is received within an elongated curved recess in the support shoe as shown. A fixed end bar that is secured to the support shoe may be provided at each end to prevent the support shoe and blade element from separating from one another along the axial direction of the roll 124.

The plate element 104 is adapted to be received within a conventional doctor blade holder 128 that may, for example, include a top plate 103 having an elongated blade receiving structure 114 and mounting structure 102 for coupling to mounting structure on a tube tray 126. The receiving structure 114 may further receive an elongated series of pins or a ridge 120 in the plate element to further secure the plate element within the receiving structure 114. The top plate 103 is positionable with respect to the tube tray 126 by actuation of loading and unloading tubes 115, 116 as is conventionally known, and the tube tray 126 may be secured to a positionable doctor-back 101.

The cleaning apparatus 100 is therefore provided to be positioned between a surface 108 of a roll 124 and a conventional doctor blade holder. This not only permits the cleaning apparatus 100 to be quickly and easily inserted into a doctor blade holder of a web or roll processing machine during machine down-time, but also provides that the cleaning apparatus requires very little clearance. Having the plate element attached to the support shoe facilitates cleaning by maintaining a secure hold on the pad while it is applied against the moving surface, and further provides that doctor blade holders that provide reciprocating motion may also be used with the cleaning apparatus to provide further improved cleaning.

The plate element 104 is held in position in a doctor blade holder in the same manner as a doctor blade may be held. This provides that when a web or roll processing machine is shut down, the doctor blade may be removed, and a cleaning apparatus 100 may be inserted into the doctor blade holder. The surface to be cleaned may then be set into motion, and the pads of the cleaning apparatus may be positioned to contact the moving surface. As the roll 124 rotates (as shown at A in FIG. 7), the abrasive pads 112 press against the surface 108 of the roll 124. The abrasive pads may compress to some extent, and the resistive force from the pads causes the surface to be cleaned. Certain doctor blade holder assemblies may also provide reciprocating motion along the axial length of the roll, and such a feature may also be used with the cleaning apparatus of certain embodiments of the invention.

The cleaning apparatus 100 therefore, has two positions: a loaded position where the cleaning pads are loaded against a moving surface and an unloaded position where the cleaning pads are backed away from the moving surface. The loading/unloading operation may be accomplished by the doctor blade holder if it includes load/unload capability. For example, the doctor blade holder of FIGS. 5-7 includes the fluid expandable loading tube 115 and the fluid expandable unloading tube 116 to achieve this. Alternatively, the cleaning apparatus may be loaded and unloaded from the moving surface by rotating, or otherwise moving, the complete doctor back away from the moving surface. Typically, pneumatic or hydraulic cylinders or electric linear actuators can be used to rotate a doctor back.

In certain embodiments, the support shoe 107 may also include an internal plenum 106 that includes a fluid (such as air, water or other cleaning liquid) under pressure. The fluid is introduced into the plenum at one or both ends of the cleaning apparatus via sealed manifolds, and escapes the plenum via apertures 109 in the support shoe 107, passes through aligned apertures in the backing plates 111, and then passes through the abrasive pads 112 to contact the surface 108 of the roll while the roll surface is being cleaned to assist in the cleaning process and to facilitate removal of debris. The fluid may be a cooling fluid, such as air, for cooling the cleaning pads or a cleaning fluid, such as a solvent or detergent, for cleaning the pads and the moving surface. In accordance with a further embodiment, an additional aperture 110 may be provided in the support shoe between the two pads such that the fluid contacts the surface 108 directly.

Figure 8:
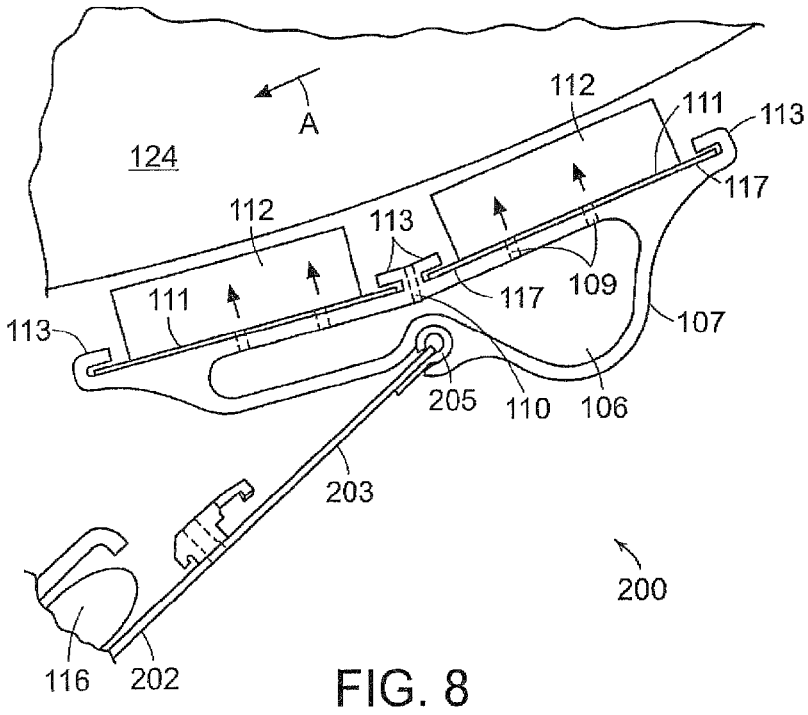
FIG. 8 shows an illustrative diagrammatic enlarged view of a portion of a cleaning apparatus of another embodiment of the invention.

As shown in FIG. 8, in accordance with a further embodiment of the invention, a cleaning apparatus 200 may include a support shoe 107, backing plates 111 and pads 112 as discussed above with reference to FIGS. 5-7 and wherein further references numerals common to FIGS. 5-7 denote identical features in the embodiment of FIG. 8. The cleaning apparatus of the embodiment of FIG. 8, however, includes a plate element 203 that attaches to the support shoe 107 via an elongated curved hinge element 205 that is received within an elongated curved recess in the support shoe as discussed above with reference to FIGS. 5-7.

The other end of the plate element 203 is not received within a doctor blade holder, but rather is formed integral with a top plate 202 of the doctor blade holder assembly. Again, loading and unloading tubes 115, 116 may be employed to position the top plate 202 (and thereby the cleaning apparatus) with respect to a doctor-back. Alternatively, the complete holder 202 could be replaced with a suitable structure, planar or otherwise, that is attached directly to the doctor back and includes a leading edge configured similar to the blade edge to provide a pivotable mounting of the pad support structure. In this latter case, the doctor back would require actuators to position the doctor in both a load and unload position.

It is preferred to have the pad support structure mounted on a pivot (e.g., 105 or 205) to allow for some bi-directional rotation. This ensures that the cleaning pads are loaded evenly against the moving surface. However, it should be noted that a non-pivoting (rigid type) and other connection means (flexible) could also be used successfully and are to be considered within the scope of this patent application.

Figure 9:
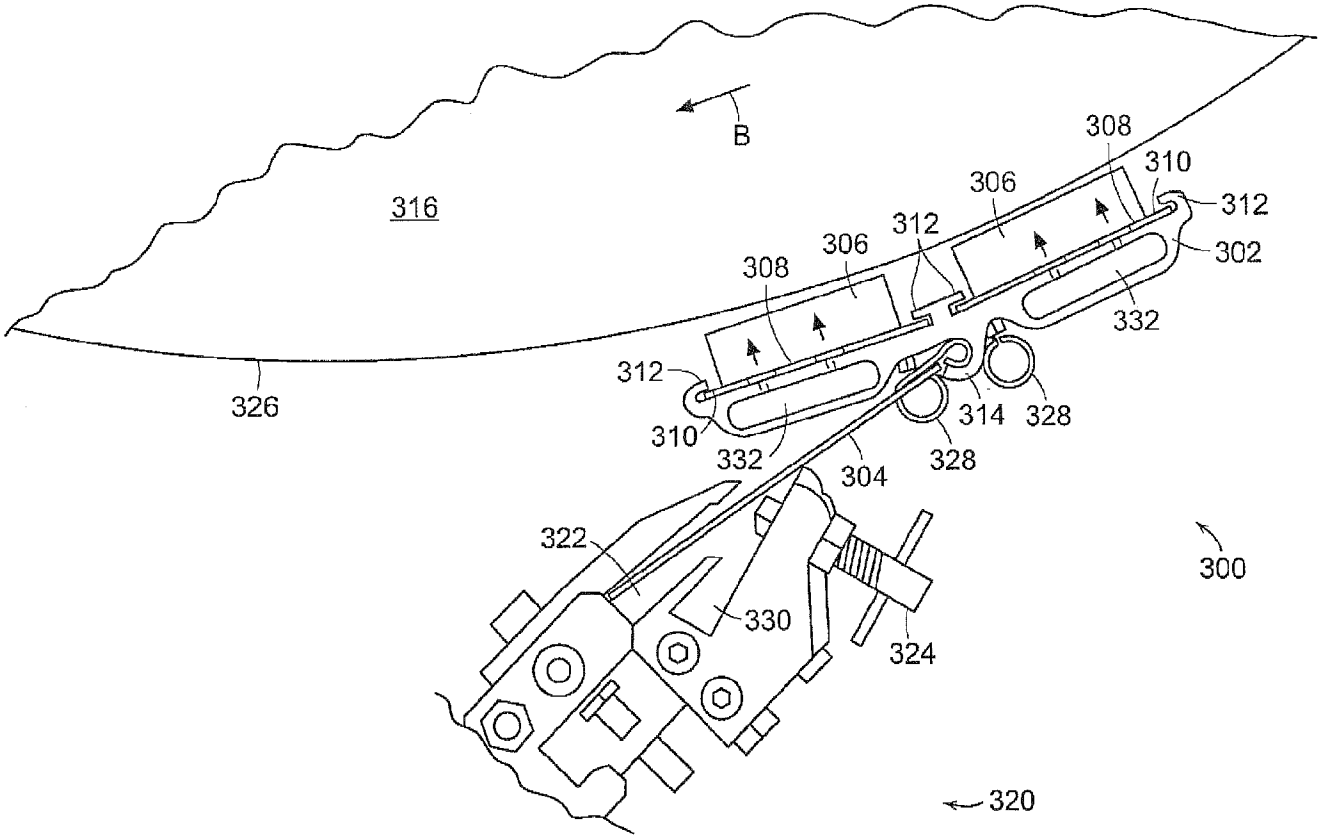
FIG. 9 shows an illustrative diagrammatic side view of a roll cleaning apparatus in accordance with a further embodiment of the invention.

As shown in FIG. 9, a cleaning apparatus 300 in accordance with a further embodiment of the invention includes a support shoe 302 that is pivotally coupled to a plate element 304. Cleaning pads 306 are each attached to a backing plate 308 (e.g., via adhesive or by using a hook-and-loop type fastener), and each backing plate 308 includes two elongated edges 310 that are received within elongated slots 312 that are formed in the support shoe 302. Again, each backing plate 308 may be formed, for example, of an extruded aluminum, a pultruded fiber reinforced plastic, a laminate composite material or other suitable material. Releasable pins 328 may also be provided for engaging each pad to prevent axial movement of the pad during use.

The support shoe 302 is coupled to the plate element 304 via an elongated curved hinge element 314 that is received within an elongated curved recess in the support shoe as shown. Again, a fixed end bar that is secured to the support shoe may be provided at each end to prevent the support shoe and blade element from separating from one another along the axial direction of the roll 316. The plate element 304 is adapted to be received within another conventional doctor blade holder 320 that may, for example, include a blade receiving area 322 and a spring locking pin 324 for securing a backing blade (not shown) within a backing blade receiving area 330 during doctoring. The doctor blade holder 320 may also be position adjustable to bring a doctor blade toward and away from a surface 326 of the roll 316 as is conventionally known.

The cleaning apparatus 300 is therefore provided to be positionable between a surface 326 of the roll 316 and a conventional doctor blade holder 320. This not only permits the cleaning apparatus 300 to be quickly and easily inserted into a doctor blade holder of a web or sheet processing machine during machine down-time, but also provides that the cleaning apparatus requires very little clearance. In this embodiment as well, having the plate element attached to the support shoe also facilitates cleaning by maintaining a secure hold on the pad while it is applied against the moving surface, and further provides that doctor blade holders that provide reciprocating motion may also be used with the cleaning apparatus to provide further improved cleaning.

Again, the plate element 304 is held in position in the doctor blade holder 320 in the same manner as a doctor blade may be held therein. This provides that when a web or roll processing machine is shut down, the doctor blade may be removed, and a cleaning apparatus 300 may be inserted into the doctor blade holder. The surface to be cleaned may then be set into motion, and the pads of the cleaning apparatus may be positioned to contact the moving surface. As the roll 316 rotates and the abrasive pads 306 press against the surface 326 of the roll 316, the abrasive pads may compress to some extent, the resistive force from the pads cause the surface to be cleaned. Certain doctor blade holder assemblies may also provide reciprocating motion along the axial length of the roll, and such a feature may be employed in cleaning apparatus of the present invention to further improve cleaning in certain applications.

The cleaning apparatus 300 further includes two internal plenums 332 for providing a fluid via sealed manifolds as discussed above to the surface 326 to be cleaned via apertures 340 in the support shoe 302 as well as corresponding apertures in the backing plates 310, so that the fluid may contact the surface 326 through the pads 306 as the roll surface rotates as shown at B to assist in the cleaning process and to facilitate removal of debris. Again, the fluid may be a cooling fluid, such as air, for cooling the cleaning pads or a cleaning fluid, such as a solvent or detergent, for cleaning the pads and the moving surface.

Figure 10:
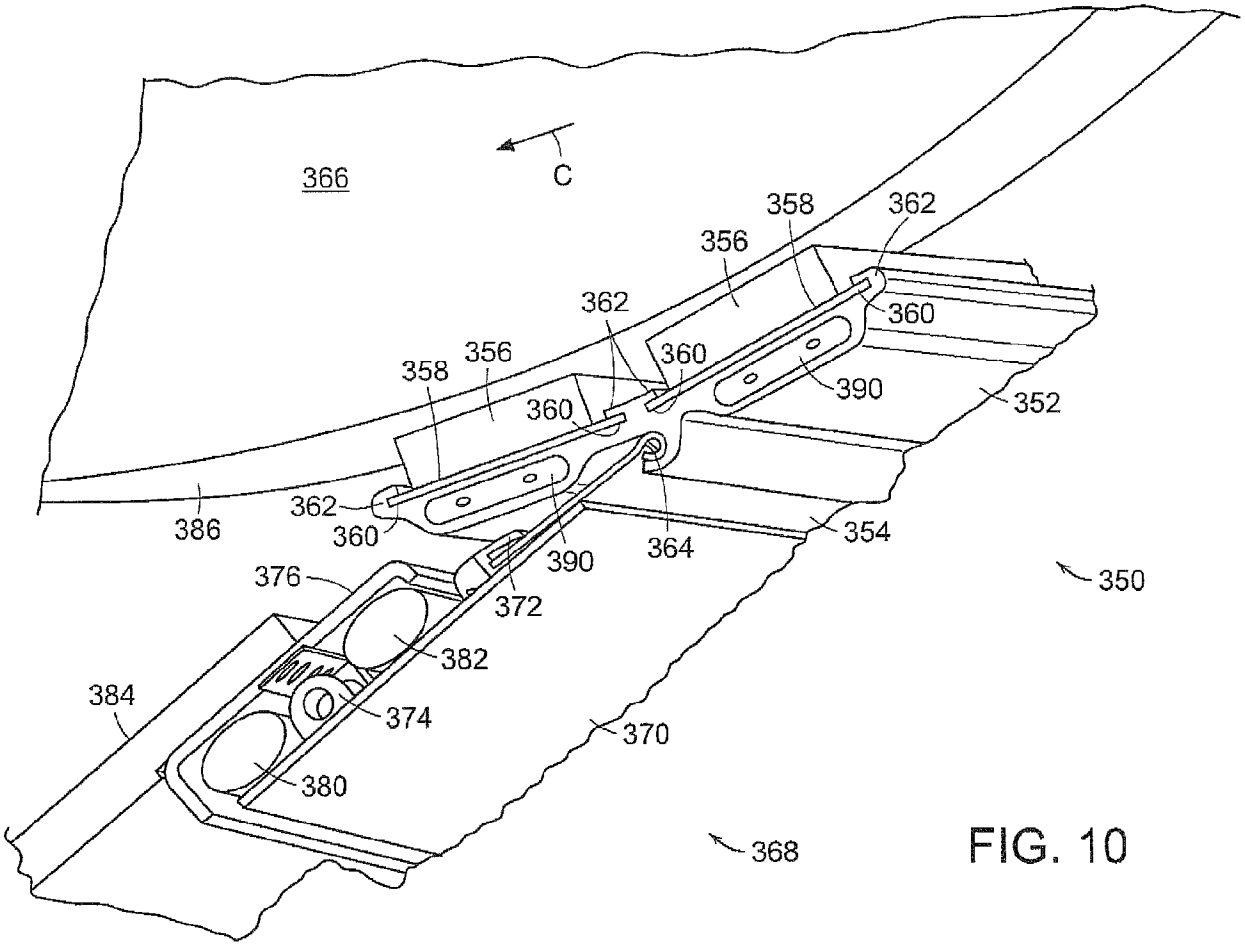
FIG. 10 shows an illustrative diagrammatic isometric view of a portion of the roll cleaning apparatus of FIG. 9 used with a different doctor blade holder system.

As shown in FIG. 10, a cleaning apparatus 350 in accordance with a further embodiment of the invention includes a support shoe 352 that is pivotally coupled to a plate element 354. Cleaning pads 356 are each attached to a backing plate 358 (e.g., via adhesive or by using a hook-and-loop type fastener), and each backing plate 358 includes two elongated edges 360 that are received within elongated slots 362 that are formed in the support shoe 352. Each backing plate 358 may be formed, for example, of an extruded aluminum, a pultruded fiber reinforced plastic, a laminate composite material or other suitable material. The support shoe is coupled to the plate element 354 via an elongated curved hinge element 364 that is received within an elongated curved recess in the support shoe as shown. A fixed end bar that is secured to the support shoe may be provided at each end to prevent the support shoe and blade element from separating from one another along the axial direction of the roll 366.

Figure 12:
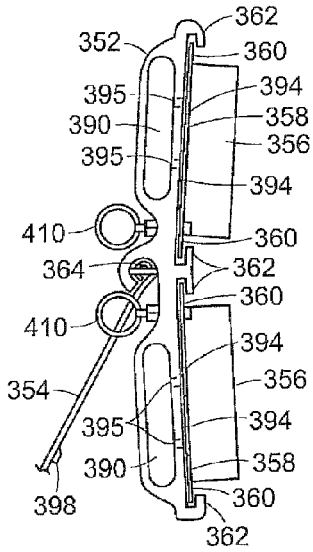
FIG. 12 shows an illustrative diagrammatic side view of the cleaning apparatus of FIG. 10 further including backing plate retainer clips.

The plate element 354 is adapted to be received within a conventional doctor blade holder 368 that may, for example, include a top plate 370 having an elongated blade receiving structure 372 and mounting structure 374 for coupling to mounting structure on a tube tray 376. Again, the receiving structure 372 may further receive an elongated series of pins or a ridge 398 (as shown in FIG. 12) in the plate element to further secure the plate element within the receiving structure 372. The top plate 370 is positionable with respect to the tube tray 376 by actuation of loading and unloading tubes 380, 382 as is conventionally known, and the tube tray 376 may be secured to a positionable doctor-back 384.

The cleaning apparatus 350 is also therefore provided to be positioned between a surface 386 of a roll 366 and a conventional doctor blade holder 368. This not only permits the cleaning apparatus 350 to be quickly and easily inserted into a doctor blade holder of a web or roll processing machine during machine down-time, but also provides that the cleaning apparatus requires very little clearance.

The plate element 354 is held in position in a doctor blade holder in the same manner as a doctor blade may be held. This provides that when a web or roll processing machine is shut down, the doctor blade may be removed, and a cleaning apparatus 350 may be inserted into the doctor blade holder 368. The surface to be cleaned may then be set into motion, and the pads of the cleaning apparatus may be positioned to contact the moving surface. As the roll 366 rotates and the abrasive pads 356 press against the surface 386 of the roll 366, the abrasive pads may compress to some extent, the resistive force applied by the pads cause the surface to be cleaned. Certain doctor blade holder assemblies also provide reciprocating motion along the axial length of the roll, and such a feature ma also be used with the cleaning apparatus of the invention. Again, having the plate element attached to the support shoe also facilitates cleaning by maintaining a secure hold on the pad while it is applied against the moving surface, and further provides that doctor blade holders that provide reciprocating motion may also be used with the cleaning apparatus to provide further improved cleaning.

The cleaning apparatus 350 further optionally includes two internal plenums 390, 392 for providing a fluid via sealed manifolds as discussed above to the surface 386 to be cleaned via apertures 394 in the support shoe 352 as well as corresponding apertures in the backing plates 358, so that the fluid may contact the surface 386 through the pads 356 as the roll surface rotates as shown at C to assist in the cleaning process and to facilitate removal of debris. Again, the fluid may be a cooling fluid, such as air, for cooling the cleaning pads or a cleaning fluid, such as a solvent or detergent, for cleaning the pads and the moving surface.

Figure 11:
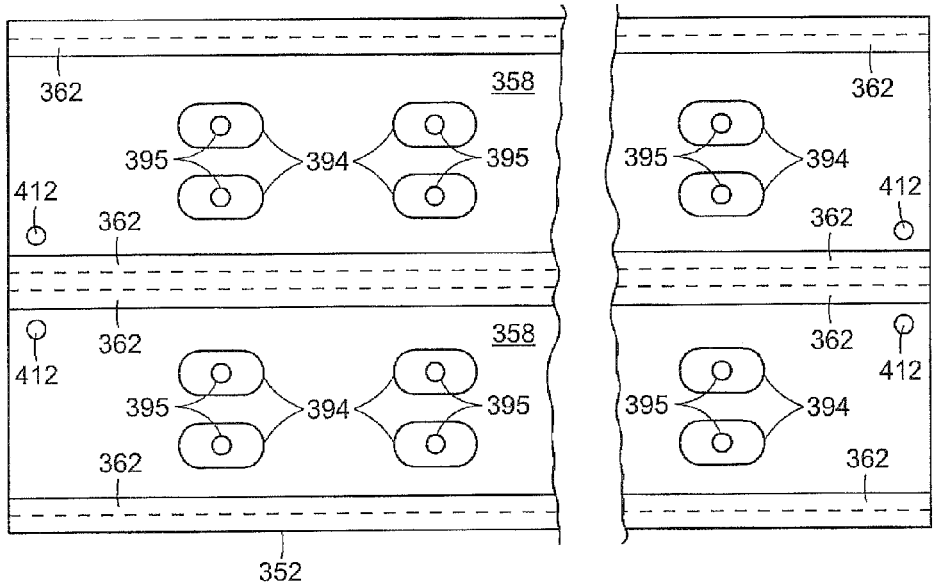
FIG. 11 shows an illustrative diagrammatic plan view of the support structure of the cleaning apparatus of FIG. 9.

The backing plates 358 and support shoe 352 are further shown in FIG. 11 to include a plurality of apertures 394 along the elongated length of the backing plates 358, as well as aligned smaller apertures 395 along the elongated length of the support shoe 352 in communication with each of the plenums 390. As further shown in FIG. 12, backing plate retainer clips 410 may be inserted through clip apertures 412 in the support shoe 352 for securing the backing plates 358 and pads 356 to the support shoe 352 and preventing the backing plates from moving in the axial direction during use.

The cleaning apparatus 350 therefore, has two positions: a loaded position where the cleaning pads are loaded against a moving surface and an unloaded position where the cleaning pads are backed away from the moving surface. The loading/unloading operation can be accomplished by the doctor blade holder if it includes load/unload capability, for example, by the loading and unloading tubes 380, 382. Alternatively, the cleaning apparatus 350 may be loaded and unloaded from the moving surface by rotating, or otherwise moving, the complete doctor back away from the moving surface. Typically, pneumatic or hydraulic cylinders or electric linear actuators can be used to rotate a doctor back.

Figure 13:
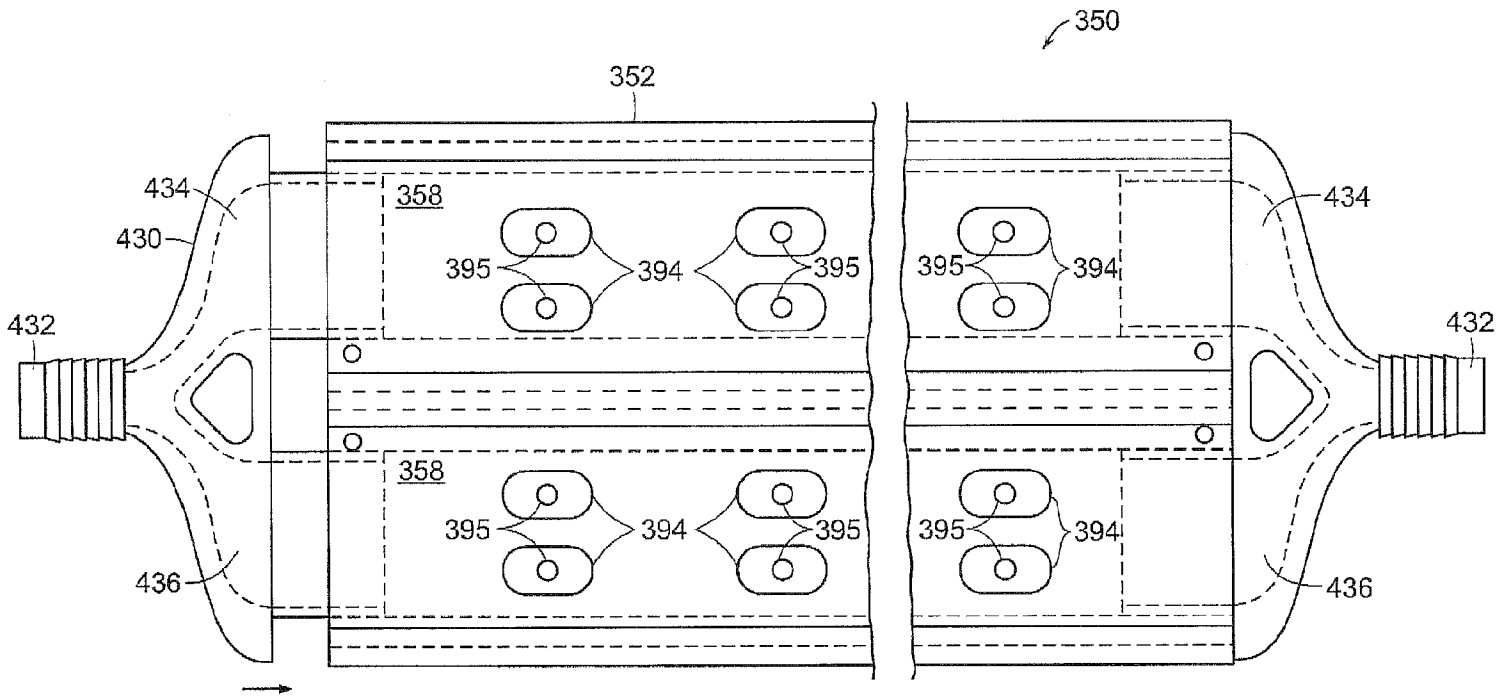
FIG. 13 shows an illustrative diagrammatic plan view of a support shoe in accordance with a further embodiment of the invention including a fluid cleaning assist enclosure.
Figure 14:
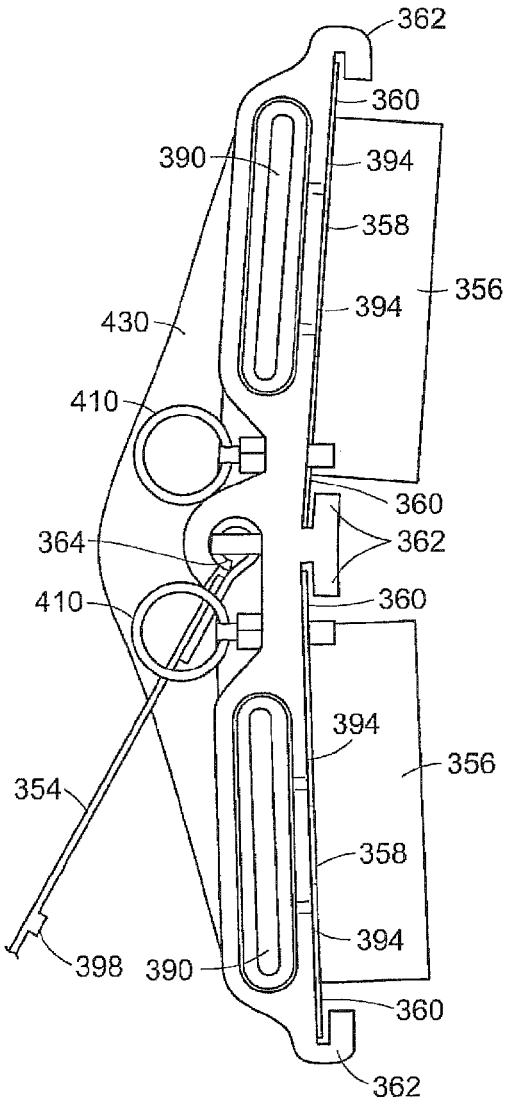
FIG. 14 shows an illustrative diagrammatic side view of the cleaning apparatus of FIG. 13.

As further shown in FIGS. 13 and 14, the cleaning apparatus 350 may be provided with sealed manifolds 430 for insertion into each end of the cleaning apparatus 350 (shown in FIG. 13 without the cleaning pads 356). Each sealed manifold 430 includes a port 432 for receiving a fluid under pressure, and each sealed manifold 430 provides an upper channel 434 and a lower channel 436 for providing the fluid under pressure to the plenums 390 in the support shoe 440. The plenums 390 communicate with apertures 395 in the support shoe 440, and these apertures 395 are also in fluid communication with apertures 394 in the backing plates 358. The sealed manifolds 430 and plenums 390 ensure that the pressure of the fluid throughout the plenums 390 and exiting the apertures 442 remains sufficiently constant. FIG. 14 shows the cleaning apparatus with the sealing manifold at the closer end removed.

The cleaning pads of the above disclosed embodiments may consist of a non-woven synthetic, natural fiber or a metallic substrate to which abrasive particles are bonded. Various types and sizes of abrasive particles can be used depending on the application requirements. Aluminum Oxide, Ceramic Aluminum Oxide, Silicon Carbide, Tungsten Carbide and Zirconia Alumina may typically be used. As discussed above, the cleaning pads are attached to the backing plates, which have a slightly wider base. Adhesives, rivets or other mechanical fastening means can be used to attach the cleaning pad to the backing plate.

The cleaning pads are typically installed by attaching them to a backing plate and then sliding the backing plate in from one end of the support shoe. Alternatively, if there is not available space to install the backing plates from the end, the backing plates and the elongated slots may be configured so that the backing plates may be installed from the top. One method of accomplishing this is to notch out (for example 3" long notches) the backing plate edges and the support shoe grooves to allow for installation of the cleaning pad from the top. The edges in the backing plates could be notched and offset from the notches in the support shoe so that backing plates could be installed by placing the directly down onto the support shoe and then sliding it in the cross-machine direction a distance that corresponds to the notch length. This would secure the cleaning pads to the support shoe. The preferred methods of securing the cleaning pads to the support shoe is as described above; however, there are numerous other ways to successfully secure a cleaning pads to a support shoe. In cases where the support shoe includes a fluid plenum and fluid apertures, either the fluid may pass through the pads and optionally may further pass through additional apertures in the pads to facilitate flow of the fluid to the moving surface.

In accordance with various embodiments, the planar mounting member may include slight variations due to manufacturing, and may further include intended variations as long as the substantially planar mounting member may be secured to a portion of a doctoring apparatus.

Those skilled in the art will appreciate that numerous modifications and variations may be made to the above disclosed embodiments without departing from the spirit and scope of the invention.

What is claimed is:

1. A cleaning apparatus for processing a moving surface, said cleaning apparatus comprising at least one cleaning pad that is coupled to a support shoe, said support shoe also being attached to a first end of a plate element, and said plate element including a second end that is received by a doctor blade holder, wherein said cleaning apparatus includes at least one internal plenum for providing a fluid through the cleaning pad.

2. The cleaning apparatus as claimed in claim 1, wherein said first end of the plate element is pivotally coupled to the support shoe.

3. The cleaning apparatus as claimed in claim 1, wherein said at least one cleaning pad is coupled to the support shoe via a backing plate.

4. The cleaning apparatus as claimed in claim 3, wherein said backing plate is formed of extruded aluminum.

5. The cleaning apparatus as claimed in claim 3, wherein said backing plate is formed of a pultruded fiber reinforced plastic.

6. The cleaning apparatus as claimed in claim 3, wherein said cleaning apparatus is adapted to be quickly and easily installed into a conventional doctor blade holder during machine down-time.

7. The cleaning apparatus as claimed in claim 6, wherein cleaning pad may be applied to the moving surface using a loading tube that causes the doctor blade holder to rotate such that the cleaning pad is moved into contact with the moving surface.

8. The cleaning apparatus as claimed in claim 1, wherein said cleaning apparatus includes at least two cleaning pads.

9. The cleaning apparatus as claimed in claim 1, wherein said cleaning apparatus includes at least two internal plenums for providing the fluid through at least two cleaning pads.

10. The cleaning apparatus as claimed in claim 1, wherein fluid is air under a positive pressure.

11. The cleaning apparatus as claimed in claim 1, wherein said at least one internal plenum is defined by walls that are integral with the support shoe on which the cleaning pad is mounted.

12. The cleaning apparatus of clam 1, wherein said plate element is integrally formed with a top plate of a doctor blade holder.

13. The cleaning apparatus as claimed in claim 1, wherein said support shoe is sufficiently low in profile that a doctor-back to which the doctor blade holder is pivotally attached is in substantially the same position during use of the cleaning apparatus as it would be during machine processing using a doctor blade coupled to the doctor-back.

14. The cleaning apparatus as claimed in claim 1, wherein said support shoe is formed of extruded aluminum.

* * * * *